United States Patent [19]

Yoshikawa et al.

[11] 3,977,175

[45] Aug. 31, 1976

[54] DRAW-TEXTURING POLYESTER YARNS

[75] Inventors: Hirofumi Yoshikawa, Iwakuni; Isao Hamana, Ibaraki; Shiro Kumakawa, Iwakuni, all of Japan

[73] Assignee: Teijin Limited, Osaka, Japan

[22] Filed: Dec. 9, 1974

[21] Appl. No.: 531,176

[30] Foreign Application Priority Data

Dec. 13, 1973 Japan ..... 48-138064
Apr. 3, 1974 Japan ..... 49-36915

[52] U.S. Cl. ..... 57/157 TS
[51] Int. Cl.[2] ..... D02G 1/02
[58] Field of Search ..... 57/34 HS, 34.5, 34 R, 57/36, 157 R, 157 TS, 157 MS, 157 S

[56] References Cited

UNITED STATES PATENTS

| | | | |
|---|---|---|---|
| 2,980,492 | 4/1961 | Jamieson et al. | 57/157 S UX |
| 3,708,970 | 1/1973 | McFarlane | 57/157 TS X |
| 3,733,801 | 5/1973 | Jones | 57/157 TS |
| 3,796,036 | 3/1974 | Parker | 57/34 HS X |
| 3,816,994 | 6/1974 | Small | 57/157 TS |
| 3,874,159 | 4/1975 | MacFarlane | 57/157 TS |
| 3,877,213 | 4/1975 | McFarlane | 57/157 TS X |
| 3,910,027 | 10/1975 | Bach et al. | 57/157 TS |

*Primary Examiner*—Donald E. Watkins
*Attorney, Agent, or Firm*—Sherman & Shalloway

[57] ABSTRACT

Textured polyester yarn is prepared from multifilament yarn composed of a synthetic linear ethylene terephthalate polyester by draw-texturing at a draw ratio of 1.05 – 1.30X, using a heat-setting temperature of about 170° – 240°. Feed yarn for said draw-texturing process has (a) a break elongation of 40 – 80%, (b) a density of above 1.371 g/cm$^3$, and (c) a boil-off shrinkage of less than 8%. Said feed yarn is prepared by modified melt spinning of the foregoing polyester at a speed of about 3000 – 5000 meters per minute.

19 Claims, No Drawings

DRAW-TEXTURING POLYESTER YARNS

BACKGROUND OF THE INVENTION

This invention relates to a process for preparing draw-textured polyester yarns and novel feed yarns suitable for use in such a process.

It has been suggested to produce permanently crimped textured yarns by drawing and false-twist texturing of undrawn polyester yarns melt-spun at a windup speed of about 3000 – 4000 yards per minute, as for example in U.S. Pat. Nos. 3,771,307 and 3,772,872.

According to these processes, it is possible to produce draw-textured yarns having good crimp properties superior to those of conventional textured yarns processed at similar twist levels and heat-setting temperatures at high productivity with low cost.

However, polyester feed yarns obtained by melt spinning at a speed of about 3000 – 4000 yards per minute have relatively poor stability during long periods of storage or transport, and significant deterioration and unevenness take place in the draw-texturing of such stored feed yarns. For example, the feed yarns, after storage for 20 days at 35°C. or higher, are more susceptible to filament breakage and fluffs during the draw-texturing process, than freshly spun yarns. Furthermore, textured yarns obtained from said stored feed yarns are dyed more deeply or unevenly than those from as-spun yarns. In addition, it is necessary to exercise special caution in threading-up the yarn to the draw-texturing machine, because great shrinkage of said feed yarns takes place when they come into contact with the heater. And textured yarns obtained from such feed yarns have poor appearance and hand, since the feed yarns become highly deformed in their cross section during the draw-texturing process.

Additional prior art of possible interest includes the following:

U.S. Pat. No. 2,604,667, related to a high-speed process for melt-spinning polyethylene terephthalate material to produce as-spun fibers and yarns.

U.S. Pat. No. 2,604,689, related to a process for melt-spinning polyethylene terephthalate material to produce tenacious, resilient fibers and yarns.

U.S. Pat. Nos. 2,952,879; 3,091,510; and 3,549,597, related to processes for producing linear terephthalate polyesters which have the property of undergoing a spontaneous and irreversible extension in length when they are heated.

U.S. Pat. No. 3,563,892, related to a textile treating composition and lubricant useful for high-temperature drawing of polyester filaments.

U.S. Pat. No. 3,594,200, related to a textile finish composition for high-speed and high-temperature twisting processing.

British Pat. No. 746,992, related to the crimping of synthetic yarns by imparting to them a temporary high twist by means of a false-twisting device.

British Pat. No. 777,625, related to a process for producing bulky synthetic yarns by the use of a flase-twisting device and heat setting.

British Pat. No. 852,579, related to producing crimped synthetic linear polymer yarns by false-twisting and drawing the as-spur yarn simultaneously.

British Pat. No. 890,053, related to a process and apparatus for crimping synthetic yarn by false-twisting.

British Pat. No. 1,333,679 (German O.L. No. 2,116,502), related to false twist-crimped polyester yarns containing at least 80 mole % of ethylene terephthalate units.

French Pat. No. 2,001,980, related to improvements for the production of bulky synthetic yarns by false-twist crimping.

The publication "Faserforchung und Textiltechnik", 9 (1958), No. 6, Pages 226–231, related to the spinning of polycondensate fibers at high delivery speeds.

The publication "Faserforchung und Textiltechnik", 11 (1960), No. 7, Pages 312–319, related to the spinning and stretching of polycondensate filaments.

The publication "Textile Industries", March 1970, Pages 117–131, related to the state of textured yarn technology in Europe.

The publication "Chemiefasern/textil-industrie", September 1973, pages 818–821; October 1973, pages 964–975; and November 1973, pages 1109–1114; related to structural changes of polyester filaments during orientation and tempering.

The publication "Chemiefasern/textil-industrie", November 1973, pages 1067–1080, related to the status and development of stretch-texturing synthetic yarns.

SUMMARY OF THE INVENTION

The present invention provides an improved draw-texturing process wherein polyester yarn is drawn and false-twist textured simultaneously or sequentially resulting in good crimp properties and excellent hand. The invention also provides feed yarn suitable for use in the process.

The improved process of the present invention comprises drawing and false-twist texturing simultaneously or sequentially a polyester feed yarn composed of a synthetic linear ethylene terephthalate polyester, the feed yarn characterized by having (a) a break elongation of 40 – 80%, (b) a density of above 1.371 g/cm$^3$ and (c) a boil-off shrinkage of less than 8%. In the process the feed yarn is drawn and false-twist textured simultaneously or sequentially at a draw ratio of 1.05 – 1.30X using a heat-setting temperature of about 170° – 240°C.

The feed yarn preferably has a birefringence of 0.09 – 0.14, an initial modulus of 600 – 1100 kg/mm$^2$, a tenacity of 3 – 4 grams per denier, a strength at first yield point of 1.0 – 1.8 grams per denier, a dry-heat shrinkage at 200°C of less than 13%, a crystal size of 30 – 45 A, and is composed of a synthetic linear ethylene terephthalate polyester having an intrinsic viscosity of 0.3 – 1.0.

DEFINITIONS AND MEASUREMENTS

A. Break Elongation (El) and Tenacity (Te)

A sample is left to stand for one day at a relative humidity of 65% at 25°C. A 20cm sample is tested on an Instron Tensile Tester at a pulling rate of 100% per minute. The tenacity (Te) is calculated by dividing the strength at the time of break by the denier of the sample before measurement, and the break elongation (El) is the elongation of the sample at the time of break.

B. Density ($\rho$)

The density ($\rho$) is measured by employing a density-gradient tube. The liquid for measurement is a mixture of carbon tetrachloride and n-heptane (see ASTM Method D1505).

C. Boil-off Shrinkage (BOS) and Dry-heat Shrinkage (DHS)

A five-turn portion of the sample yarn is taken, using a sizing reel having a 1.125 meter circumference. After removing the sample yarn from the reel, the hank length ($L_o$) is measured while applying an initial load of 1/30 gram per denier. The weight is removed and the sample yarn is immersed in boiling water for 30 minutes (BOS) or is hung in an oven maintained at 200°C. for 15 minutes (DHS). The yarn is then withdrawn, air-dried, and loaded again with the same weight, and its new length recorded respectively ($L_1$ or $L_2$). The percent shrinkage is calculatd by using the formula:

$$\text{Boil-off Shrinkage (BOS)} = \frac{L_o - L_1}{L_o} \times 100\ (\%)$$

$$\text{Dry-heat Shrinkage (DHS)} = \frac{L_o - L_2}{L_o} \times 100\ (\%)$$

D. Intrinsic Viscosity ($\eta$)

The intrinsic viscosity ($\eta$) of a polymer is defined as:

$$\text{Intrinsic Viscosity } (\eta) = \lim_{c \to o} \frac{\eta r - 1}{C}$$

In the formula, $\eta r$ is the relative viscosity obtained by dividing the viscosity of a dilute solution of a polymer by the viscosity of the solvent employed, both being at the same temperature, and C is the poymer concentration in the solution expressed as g/100cc. The intrinsic viscosities given in the present specification are calculated from viscosities measured at 35°C, using o-chlorophenol as the solvent.

E. Crystal Size (L)

The crystal size (L) is a value obtained in accordance with the following (P. Scherrer's) equation, which represents the size of a crystal in a direction approximately at right angles to the fiber axis:

$$L(A) = \frac{\lambda K}{(B-b)\cos\theta}$$

wherein

B is a (010) diffraction peak width in radian unit when the diffraction intensity is (It + Iam)/2, in which It is a diffraction intensity at (010) peak position, and Iam is a meridional X-ray diffraction intensity at a Bragg's reflection angle of $2\theta$=17.7°;

$b$ is 0.00204 radian;

$K$ is 0.94; and $\lambda$ is 1.542 A

Instrument used:

Geiger — Flex, D-9C, (Rigaku Denki Co., Ltd.)

Measurement conditions:

35 KV, 20mA, Cuk$\alpha$ radiation, (Ni-filtered)

Divergence slit — 0.15mm $\phi$

Scattering slit — 1°

Receiving slit — 0.4mm

F. Birefringence ($\Delta n$)

Sodium D rays (wavelength 589 millimicrons) are used as a light source, and the filaments are disposed in a diagonal position. The birefringence ($\Delta n$) of the specimen is computed from the following equation:

$$\Delta n = \frac{n\lambda + r}{\alpha}$$

when $n$ is the interference fringe due to the degree of orientation of the polymer molecular chain; $r$ is the retardation obtained by measuring the orientation not developing into the interference fringe by means of a Berek's compensator; $\alpha$ is the diameter of the filament; and $\lambda$ is the wavelength of the sodium D rays.

G. Initial Modulus (Mi)

A sample is left to stand for a day at a relative humidity of 65% at 25°C. A 20cm sample is tested on an Instron Tensile Tester at a pulling rate of 20% per minute. The ratio of stress to strain within the straight line part of the load-elongation curve up to 1% elongation is read off, and the initial modulus (Mi) is calculated with the following formula:

$$\text{Initial Modulus (Mi)} = \frac{\text{Stress (g)} \times \text{Density (g/cm}^3) \times 9}{0.01 \times \text{Denier}} (\text{kg/mm}^2)$$

H. Strength at First Yield Point (Yp)

A sample is left to stand for a day at a relative humidity of 65% at 25°C. A 20cm sample is tested on an Instron Tensile Tester at a pulling rate of 100% per minute to measure the load-elongation curve. Strength at first yield point is a load at the first inflection point in the load-elongation curve.

I. Total Percentage Crimp (TC)

The yarn is place under two loads, a lighter load of 2 mg/de (milligrams per denier) and a heavier load of 0.2 g/de (grams per denier). After a lapse of 1 minute, the length ($l_o$) is measured. Immediately the heavier load is removed, and the yarn under the lighter load is placed in boiling water. It is taken out of the water 20 minutes later. The lighter load is removed, and the yarn is dried under ambient conditions for 24 hours. Both loads are again placed on the dried yarn, and its length ($l_2$) is measured after a lapse of 1 minute. Immediately, the heavier load is removed, and after a lapse of 1 minute, its length ($l_3$) is measured. The total percentage crimp (TC) is expressed by the equation:

$$TC = \frac{l_2 - l_3}{l_0} \times 100\ (\%)$$

J. Dye Exhaustion (L value)

The yarn processed is knitted on a circular knitting machine. The knitted article is dyed for 30 minutes in boiling water using a dye bath containing 3 – 4% of Eastman Polyester Blue BLF and 0.5 g/liter of "Monogen" (trademark of Daiichi Kogyo Seiyaku K.K. for a surface-active agent) at a goods-to-liquor ratio by weight of 1:100. The lightness (L value) of the dyeing is measured by a CM - 20 type color differential meter, (Nippon Color Machine Company). This L value is employed as the dye exhaust. Larger L values mean lighter colors, and smaller L values mean darker colors.

K. Torque (Tq)

A length of about one meter of the yarn is held in a generally horizontal position and a load of 1 mg/de is placed at the center of the yarn. The two ends of the yarn are then brought together, which causes the two halves of the yarn to twist together. The torque (Tq) is the number of twists in a length ($y$) of the double twisted yarn which contains two 25cm lengths of yarn (i.e. one 25cm length from each half of the yarn). Because the doubled yarns is shortened by the twisting together of the two halves, the length ($y$) is less than 25cm. The number of twists can be determined visually or by turning the load until all the twist is removed. Twenty such measurements are made and the average is taken.

L. Degree of Cross Section Deformation (R value)

Twenty filaments are measured for the maximum diameter ($b$) of their cross section as well as the maximum diameter ($a$) coplanar and at right angles to said diameter ($b$). The ratio b/a is then calculated for the filaments and averaged to obtain the degree of cross section deformation (R value). The greater the R value, the greater is the deformaton.

M. Dye Uneveness (Streaking)

The textured yarn is knitted in a cylindrical sleeve 3 inches in diameter and 2 inches in length. This is then dyed under the following conditions with "Eastman Polyester Blue GLF".

Dye Concentration: 4% o.w.f. (based on fiber)
Liquid Ratio: 1 : 50
Temperature: 60 minutes at boiling After drying the dyed sleeve, it is examined with the naked eye. Where the dyed sleeve has streaks of deeply dyed portions in the peripheral direction, the sleeve is considered to be dyed unevenly (streaked).

DETAILED DESCRIPTION OF THE INVENTION

The feed yarns of the present invention consist essentially of synthetic linear ethylene terephthalate polyester multi-filaments. The term "synthetic linear ethylene terephthalate polyester" means a substantially linear polyester containing at least 85 mole percent, preferably at least 95 mole percent, of ethylene terephthalate units. The preferred polyester is a polyethylene terephthalate, but copolyesters containing less than 15 mole percent of other copolymerizable components may also be used.

Examples of other acid components to be copolymerized with ethylene terephthalate include dibasic acids such as phthalic acid, isophthalic acid, naphthalene-2,6-dicarboxylic acid, adipic acid, oxalic acid, sebacic acid or suberic acid. Examples of other alcohol components that can be copolymerized with ethylene terephthalate are dihydric alcohols such as polymethylene glycols having 2 to 10 carbon atoms (trimethylene glycol and butylene glycol, for example) and cyclohexane dimethanol.

The polyester may contain a minor amount of a modifier such as 5-oxydimethyl isophthalate, 5-oxydimethyl hexahydroisophthalate, benzene-1,3,5-tricarboxylic acid, para-carbomethoxyphenyl diethyl phosphonate, 3,5-dicarboxy phenyl diethyl phosphate, pentaerythritol, glycol, phosphoric acid, triphenyl phosphate, tri-1-carbomethoxyphenyl phosphate, triphenyl arsenite, tricapryl boric acid, sorbitan, trimesic acid or diethylene glycol.

The polyester may also contain minor amounts of the usual additives, such as delustrants, antistats, antioxidants, pigments, dyestufffs and fireproofing agents.

The feed yarn useful in the present invention consists essentially of the polyester above-mentioned having an intrinsic viscosity of 0.3 – 1.0.

The feed yarn according to this invention should be an undrawn yarn obtained by the modified melt-spinning process and having such properties as follows:

a. Break elongation (El.) of 40 – 80%, preferably 50 – 75%, and more preferably of 60 – 70%.
b. Density ($\rho$) of above 1.371 g/cm$^3$, preferably 1.372 – 1.395 g/cm$^3$, and more preferably 1.373 – 1.394 g/cm$^3$.
c. Boil-off shrinkage (BOS) of less than 8%, preferably 1 – 7%, and more preferably 2 – 6%.

In the case of a feed yarn having a break elongation of less than 40%, a textured yarn of good crimp properties is not obtainable. On the other hand, a feed yarn having a break elongation of above 80% is highly deformed during the draw-texturing operation. A yarn of a density not more than 1.371 g/cm$^3$ tends to become deteriorated during storage. For example, the storage of a conventional yarn in an atmosphere of 65% relative humidity and 35°C, for even 20 days, results in many filament breakages and fluffs during the draw-texturing operation. In sharp contrast, the feed yarn of this invention may be stored for at least 90 days at 65% relative humidity and a higher temperature of 40°C without significant degradation. A yarn having a boil-off shrinkage of above 8% shrinks so much on contact with the heater that difficulty is experienced in threading up the yarn to the draw-texturing machine.

In the invention, it is recommended to use a feed yarn having the following properties in addition to the above-described properties.

d. Birefringence ($\Delta n$) of 0.09 – 0.14, especially 0.10 – 0.13.
e. Initial modulus (Mi.) of 600 – 1,100 kg/mm$^2$, especially 700 – 900 kg/mm$^2$.
f. Tenacity (Te.) of 3 – 4 grams per denier.
g. Strength at first yield point (Yp) of 1.0 – 1.8 grams per denier.
h. Dry-heat shrinkage (DHS) at 200°C of less than 13%.

The foregoing feed yarn has usually a crystal size (L) of about 30 – 45 Angstroms, and a degree of crystallinity as measured by the X-ray method described in U.S. Pat. No. 2,931,068 in the range of about 40 – 65%. Although the titer of the feed yarn should be selected according to the final intended use of the textured yarn, generally a feed yarn having a titer of 2 – 7 denier per filament, especially 3 – 6 denier per filament, is useful.

The feed yarn may be composed of filaments having a round cross section or a modified cross section such as tri-lobal or octa-lobal cross section. Furthermore, the feed yarn may consist of a mixture of filaments of varying denier size.

A feed yarn such as described above possesses a long shelf life, there being substantially no deterioration in its properties during storage. For instance, even if this yarn is left to stand for 90 days in an atmosphere of 65% relative humidity at 40°C., there is no difference as compared with the as-spun yarn in respect of its processability during the draw-texturing process or the properties of the textured yarn obtained. Hence, this feed yarn can stand long periods of storage or transport. For instance, it can be transported overseas for the usual method of false twisting or can be stored for several months in ordinary warehouses.

Further, in threading-up this feed yarn to a draw-texturing machine, there is practically no shrinkage even though the yarn contacts the heater. Thus, there is the advantage that the threading-up operation is made exceedingly easy to perform.

A feed yarn such as above described can be prepared commercially advantageously in the following manner. A polyester having an intrinsic viscosity in the range of 0.3 – 1.0, and preferably 0.55 – 0.80, is spun by extrusion through a spinneret at a temperature 20° – °C. higher than its melting point. The freshly spun filaments are then cooled with air to a temperature not exceeding a temperature 40°C. higher than the glass transition point of the aforesaid polyester (Tg + 40°C.) and preferably a temperature from (Tg – 20°C.) to (Tg + 20°C.). The so cooled filaments are then caused to travel through a heating zone having a length of 100 – 200cm and a temperature of 140° – 210°C., preferably 150°– 200°C., and thereafter wound up at a speed of 2,600 – 5,500 meters per minute, and preferably 3,000 – 5,000 meters per minute.

By "glass transition point (Tg) of the polyester", as used herein, is meant a value as measured by the method described in U.S. Pat. No. 2,556,295. The Tg of amorphous polyethylene terephthalate is about 70°C. The temperature of the heating zone is a temperature of the atmosphere in the neighborhood of the filaments, the measurement being made at a point 5 millimeters from the outer side of the traveling filament bundle.

In carrying out the present invention on a commercial scale, the atmosphere through which the withdrawn filaments first travel is conveniently heated at a temperature of 140° – 210°C. by disposing, say, a heating tube, slit heater, etc., having a heating zone of about 100 – 200cm and separated by a cooling zone of about 1 – 1.5 meters from the spinneret. If the heating zone is over 200cm long, the spinning apparatus becomes unwieldy and is not industrially useful. While air is advantageously used as the atmosphere, the steam or such inert gases as nitrogen and carbon dioxide may also be used. The temperature of the foregoing atmosphere need not necessarily be uniform throughout the zone, and there may be a temperature gradient from the filament entry side near the spinneret to the filament exit side near the winding part.

In this case, the undrawn filaments that are introduced to the heated atmosphere are preferably gathered together to an extent that the individual filaments do not come into intimate contact with each other. For this purpose, a ring guide having a diameter of the order of 0.5 – 3.0 centimeters is preferably disposed at a point between the cooling zone immediately below the spinneret and the heating zone, i.e., the heated atmosphere. By operating in this manner, a great reduction in filament breakages and denier unevenness is possible.

The undrawn filaments which have left the heating zone are coated with a suitable finishing agent and then taken up by a pair of godet rolls and wound up into a package with a winder. The speed at which the spun filaments are wound up must be 2,600 – 5,500 meters per minute, and preferably 3,000 – 5,000 meters per minute. When the spinning speed is outside this range, undrawn filaments having the above-indicated properties cannot be obtained. In winding up the filaments, it is also permissible to dispense with the godet rolls and wind up the filaments directly while taking them up with the winder. Further, a preferred practice is to cause a turbulent or swirling stream of gas to act on the filaments before their windup to impart the filaments with an interlacing or intertwining twist and thus provide the filaments with such a property as to bring them together.

A package of yarn wound up in this manner does not exhibit any self-elongation or shrinkage after the windup. Hence, even though the package is one of more than 10 kilograms at the time of the completion of the windup, there is no difference in the yarn properties in the outer or inner layers of the package and no possibilty of the winding of the package giving way.

The so obtained undrawn yarn is then drawn and false-twist textured at a draw ratio of 1.05 – 1.30X, and preferably 1.10 – 1.25X, and at a heat-setting temperature of 170° – 240°C., preferably 180° – 230°C. Thus is obtained a textured yarn excelling in crimping properties, dyeability and hand.

While the drawing and false-twist texturing operations are preferably carried out simultaneously, the false-twisting operation may be carried out subsequent to the drawing operation.

The expression "heat-setting temperature" is defined as the temperature of the filaments at the time of their exit from the heater and may range from about 170° to 240°C. This heat-setting temperature in the case of the contact type of heater usually closely corresponds to the established temperature of the heater. In general, a heat-setting temperature of 190° – 240°C., and especially 210° – 230°C., is preferred when preparing the highly crimped textured yarn called "O-type", while a heat-setting temperature of 170° – 220°C., and especially 180° – 210°C., is preferred when preparing the low crimped torque textured yarn called "U-type." The present invention has the advantage that, even though the heat-setting temperature becomes high during the step of drawing and false-twisting the undrawn yarn, the reduction in the properties (elongation, tenacity, etc.) of the resulting textured yarn is small. Hence, the undrawn yarn can be heat-set at a temperature of as high as 220° – 240°C. While a contact type of heater such as a heated plate is preferred, a slit heater or a tube heater may also be used, provided that the heating zone is about 100 – 200cm long. If the heating zone is over 200cm long, the drawing and false-twisting apparatus becomes unwieldy and is not industrially useful. As the means for imparting the false twist, the spindle method is most convenient, but the friction methods which utilize a hollow rotating tube or a rotating disk may also be used. The twist coefficient ($\alpha$), as defined by the expression $k = \alpha \times 32{,}500/\sqrt{De}$, where $k$ is the number of twists (T/m), and De is the denier of the feed yarn after the drawing and false-twisting step, is preferably set at 0.9 – 1.0 for obtaining a textured yarn suited for most purposes. However, it is possible in accordance with this invention, by setting the twist coefficient ($\alpha$) at 1.2 or more, to obtain a textured yarn having exceedingly high crimping properties such as was not possible to obtain previously.

A draw ratio of 1.05 – 1.30X, and preferably 1.10 – 1.25X, is used, which is an exceedingly small value when compared with the conventional draw-texturing process for undrawn polyester yarn. Hence, conventional false-twisting machines can be used after making slight modifications to them.

In producing a "U-type" textured yarn, the textured yarn obtained operating as indicated above is then submitted to a second heat treatment under an overfeed of 8 – 30% at a temperature in the range of 190° – 240°C., preferably 200° – 240°C., and moreover, about 10°C. higher than the heat-setting temperature employed in the drawing and false-twisting texturing process. A non-contact type heater such as a slit heater or a tube heater is preferably used in this heat treatment.

By operating in the manner described above, there is practically no yarn breakage or formation of fluffs or tight spots during the draw-texturing process of the undrawn yarn. Further, even though simultaneous draw-texturing is carried out, the phenomenon of cross-sectional deformation, i.e. flattening, of the individual filaments is exceedingly small. A further surprising fact is that the fluctuation in the rate of dye exhaustion ascribable to the fluctuation in the heat-setting temperature of the textured yarn of this invention is very slight. At a heat-setting temperature in the range of 170° – 240°C. a uniform dyeability is always demonstrated even though there is some fluctuation in the temperature.

Further, the textured yarn of this invention does not suffer in the least by comparison with the textured yarn obtained by draw-texturing the conventional high-speed-spun feed yarn, in respect of its crimping properties and dyeability. Thus, the textured yarn of this invention is exceedingly valuable as a weaving or knitting material. For instance, the "O-type" textured yarn is suitable as a material for overcoats, suits and sweaters, while the "U-type" yarn is suitable as a material for undergarments and hosiery.

EXAMPLE 1

A. [Preparation of Feed Yarns]

Chips of polyethylene terephthalate having a [$\eta$] of 0.64, melting point of 261°C. and Tg of 68°C. were melt-extruded at 288°C. from a spinneret having 30 holes of 0.35mm in diameter. The freshly spun filaments were then cooled to 70°C. by blowing air at about 25°C. transversely against the filaments between the spinneret and a point 1.3 meters below the spinneret, after which the filaments were gathered together by means of a ring guide having a diameter of one centimeter. This was followed by introducing the filaments to a 140-centimeter-long heated tube and passing the filaments through the heated atmosphere of said tube, followed by coating the filaments with a lubricating finish and thereafter taking up the filaments with a pair of godet rolls and winding up the filaments into a 10-kg package with a winder.

At this time, the temperature of the atmosphere inside the heated tube and the winding speed were varied as indicated in Table 1-A. The properties of the feed yarns obtained at the various conditions are shown in Table 1-A.

The feed yarn of Run 6 had a dry-heat shrinkage (DHS) of 6.3% at 180°C., 7.4% at 200°C. and 9.9% at 220°C.

In Table 1-A, the criticality of the windup speeds and temperatures are demonstrated. Control Runs Nos. 1 and 2 clearly demonstrate that a windup speed below the stated minimum of 2,600 meters per minute results in inferior, non-uniform filaments. Control Run No. 4 clearly demonstrates that a heating zone temperature below the stated minimum of 140°C. results in inferior, nonuniform filaments. Control Run No. 7 clearly demonstrates that a heating zone temperature above the stated maximum of 210°C results in inferior yarns having numerous breakages of individual filaments, making a stable windup impossible.

Table 1-A

| Spinning Conditions | | | | Properties of Feed Yarns | | | | | | | | | |
|---|---|---|---|---|---|---|---|---|---|---|---|---|---|
| Run No. | Windup Speed (m/min.) | Draft | Temp. (°C.) of heating zone | Titer (d) | Te (g/d) | El (%) | Mi (kg/mm²) | $\rho$ (g/cm³) | BOS (%) | $\Delta n$ | L (A) | Yp (g/d) | Remarks |
| 1* | 2000 | 202 | 170 | 174 | 1.57 | 91.7 | 290 | 1.3560 | 36.2 | 0.054 | — | 0.59 | non-uniform filaments |
| 2* | 2500 | 202 | 170 | 172 | 2.22 | 83.7 | 570 | 1.3635 | 45.5 | 0.081 | — | 0.81 | " |
| 3 | 3000 | 202 | 170 | 171 | 3.44 | 74.4 | 700 | 1.3780 | 5.0 | 0.106 | 40 | 1.03 | |
| 4* | 3500 | 202 | 110 | 173 | 2.96 | 71.6 | 430 | 1.3520 | 47.2 | 0.090 | — | 0.98 | non-uniform filaments |
| 5 | 3500 | 202 | 150 | 170 | 3.45 | 63.9 | 750 | 1.3725 | 5.4 | 0.106 | 42 | 1.16 | |
| 6 | 3500 | 202 | 170 | 172 | 3.53 | 63.7 | 800 | 1.3785 | 4.6 | 0.112 | 43 | 1.17 | |
| 7* | 3500 | 202 | 220 | numerous breakages of individual filaments, stable windup impossible. | | | | | | | | | |
| 8 | 4000 | 202 | 170 | 170 | 3.83 | 57.6 | 890 | 1.3820 | 4.7 | 0.115 | 44 | 1.20 | |
| 9 | 4500 | 202 | 170 | 171 | 3.84 | 53.0 | 880 | 1.3810 | 5.2 | 0.110 | 38 | 1.26 | |
| 10 | 5000 | 202 | 170 | 166 | 3.82 | 57.3 | 860 | 1.3765 | 7.3 | 0.098 | 42 | 1.33 | |

*Note — Runs 1, 2, 4 and 7 are controls.

B. [Preparation of the Textured Yarns]

The several feed yarn packages, after their spinning, were left standing for 1 day in a room of 65% relative humidity at 25°C. This was followed by feeding the several feed yarns to a CS 12-600 Model drawing and false-twisting machine manufactured by Ernest Scragg & Sons Limited. The simultaneous draw-texturing of the several feed yarns was carried out under the conditions of a spindle speed of $29.5 \times 10^4$ rpm, a twist coefficient of 0.99 and a heater length of 100 centimeters, at the optimum draw ratio and heat-setting temperatures of the several feed yarns, after which the yarns were wound up at an overfeed of 4%.

The draw ratios and heat-setting temperatures used at this time and the properties of the resulting "O-type" textured yarns are shown in Table 1-B.

In Table 1-B, it is demonstrated that textured yarns, produced from the control yarns of Table 1-A, have high rates of dye exhaustion, dye unevenness, poor crimp properties, and in some cases, marked cross-sectional deformation. It should be noted that, in Control Run No. 1, a draw ratio above the stated maximum of 1.30X was used.

Table 1-B

| Draw-texturing condition | | | Properties of textured yarns | | | | |
|---|---|---|---|---|---|---|---|
| Run No. | Draw Ratio | Heat-setting temp. (°C.) | TC (%) | Dye Exhaustion (L value) | Dye Unevenness | Deformation (R value) | Remarks |
| 1* | 1.40 | 200 | 27.4 | 37.2 | found | 1.97 | marked cross-sectional deformation, poor crimp properties |
| 2* | 1.30 | 200 | 29.9 | 36.8 | found | 1.86 | " |
| 3 | 1.20 | 200 | 33.1 | 34.5 | no | 1.61 | |
| 4* | 1.25 | 200 | 29.0 | 36.7 | found | 1.66 | poor crimp properties |
| 5 | 1.15 | 210 | 36.1 | 33.5 | no | 1.48 | |
| 6 | 1.15 | 210 | 40.1 | 32.2 | no | 1.43 | |
| 7* | — | — | — | — | — | — | |
| 8 | 1.10 | 220 | 39.9 | 31.7 | no | 1.37 | |
| 9 | 1.10 | 220 | 40.3 | 30.5 | no | 1.26 | |
| 10 | 1.10 | 220 | 40.1 | 31.2 | no | 1.41 | |

*Note — Runs 1, 2, 4 and 7 are controls.

EXAMPLE 2

The feed yarn of Run 6 of Example 1 was draw-textured while varying the draw ratio and heat-setting temperature, employing the same drawing and false-twisting machine as that used in Example 1.

The results obtained are shown in Table 2.

In Table 2, the criticality of the draw ratio and the heat-setting temperatures are demonstrated. Control Run No. 11 used a draw-ratio below the stated minimum of 1.05X, resulting in yarn breakage due to low pre-spindle tension. Conrol Run No. 21 used a draw ratio above the stated maximum of 1.30X, resulting in a low Total Percentage Crimp (TC), a high level of dye exhaustion, dye unevenness, and a high Deformation (R) value. Control Run No. 13 used a heat-setting draw-texturing temperature below the stated minimum of 170°C. , resulting in a low TC percentage and dye unevenness. Control Run No. 18 used a heat-setting draw-texturing temperature above the stated maximum of 240°C., resulting in the formation of fluffs in exceedingly great number.

EXAMPLE 3

The filaments were spun under identical conditions as in Example 1, except that the temperature of the filaments prior to their introduction to the heated atmosphere of 170°C. was varied by varying the distance up to the heated tube from the spinneret, after which the freshly spun filaments were wound up at a speed of 3,500 meters per minute. Next, the simultaneous draw-texturing of the several feed yarns was carried out under identical conditions as in Run 6 of Example 1, the yarn being wound up at an overfeed of 4%.

The filament temperature immediately prior to their introduction to the heated atmosphere and the physical properties of the resulting feed yarn are shown in Table 3-A, while the properties of the textured yarn are shown in Table 3-B.

Run 22 is a control, which demonstrates that an inferior product is obtained at a temperature above (Tg + 40°C.). The value of Tg for amorphous polyethylene terephthalate is about 70°C. Run 26 is acceptable within the broad scope of this invention, but is outside the scope of the preferred minimum filament temperature of (Tg − 20°C.).

Table 2

| Draw-texturing condition | | | Properties of textured yarns | | | | |
|---|---|---|---|---|---|---|---|
| Run No. | Draw Ratio | Heat-setting Temp. (°C) | TC (%) | Dye Exhaustion (L value) | Dye Unevenness | Deformation (R value) | Remarks |
| 11* | 1.00 | 220 | — | — | — | — | yarn breakage due to low pre-spindle tension |
| 12 | 1.10 | 220 | 40.2 | 31.8 | no | 1.37 | |
| 13* | 1.15 | 160 | 19.5 | 31.1 | found | 1.41 | |
| 14 | 1.15 | 190 | 37.6 | 32.0 | no | 1.42 | |
| 15 | 1.15 | 200 | 39.4 | 33.3 | no | 1.41 | |
| 16 | 1.15 | 220 | 42.3 | 32.0 | no | 1.42 | |
| 17 | 1.15 | 230 | 42.5 | 30.9 | no | 1.44 | |
| 18* | 1.15 | 250 | — | — | — | — | formation of fluffs in exceedingly great number |
| 19 | 1.20 | 220 | 40.4 | 34.6 | no | 1.54 | |
| 20 | 1.30 | 220 | 35.8 | 35.3 | no | 1.61 | |
| 21* | 1.40 | 220 | 29.6 | 37.3 | found | 1.86 | |

*Note — Runs 11, 13, 18 and 21 are controls

Table 3-A

| Filament | | Properties of feed yarns | | | | | | | |
|---|---|---|---|---|---|---|---|---|---|
| Run No. | temp. (°C) | Titer (d) | Te (g/d) | El (%) | Mi (kg/mm²) | ρ (g/cm³) | BOS (%) | Δn | Remarks |
| 22* | 115 | 171 | 3.16 | 80.2 | 710 | 1.3765 | 4.7 | 0.101 | Breakage of filaments occurred |
| 23 | 95 | 172 | 3.28 | 76.3 | 730 | 1.3772 | 4.5 | 0.103 | |
| 24 | 74 | 171 | 3.32 | 73.4 | 760 | 1.3785 | 4.8 | 0.106 | |
| 25 | 62 | 170 | 3.47 | 67.3 | 810 | 1.3810 | 4.6 | 0.109 | |

Table 3-A-continued

| Run No. | Filament temp. (°C) | Properties of feed yarns Titer (d) | Te (g/d) | El (%) | Mi (kg/mm²) | ρ (g/cm³) | BOS (%) | Δn | Remarks |
|---|---|---|---|---|---|---|---|---|---|
| 26 | 53 | 171 | 3.61 | 66.7 | 830 | 1.3815 | 4.6 | 0.110 | |

*Note — Run No. 22 is a control

Table 3-B

| Run No. | Properties of textured yarns TC (%) | Dye Exhaustion (L value) | Dye Unevenness | Deformation (R value) | Remarks |
|---|---|---|---|---|---|
| 22* | 39.0 | 37.7 | found | 1.41 | fluffs present |
| 23 | 41.3 | 32.4 | no | 1.40 | |
| 24 | 41.8 | 32.7 | no | 1.39 | |
| 25 | 41.3 | 32.9 | no | 1.42 | |
| 26 | 40.0 | 35.9 | no | 1.53 | |

*Note — Run No. 22 is a control

EXAMPLE 4

The spinning of the filaments was carried out exactly as in Example 1, except that the length of the heated tube (temperature of atmosphere 170°C.) was varied, the freshly spun filaments being wound up at the rate of 3,500 meters per minute.

Table 4-A

| Run No. | Length of Heating Zone (cm) | Properties of feed yarns Titer (d) | Te (g/d) | El (%) | Mi (kg/mm²) | ρ (g/cm³) | BOS (%) | Δn | Remarks |
|---|---|---|---|---|---|---|---|---|---|
| 27 | 140 | 183 | 3.41 | 63.4 | 810 | 1.3770 | 4.5 | 0.113 | |
| 28 | 113 | 184 | 3.37 | 63.9 | 760 | 1.3730 | 5.3 | 0.106 | |
| 29* | 85 | 184 | 3.09 | 65.8 | 690 | 1.3595 | 45.0 | 0.095 | non-uniform filaments |
| 30* | 33 | 184 | 2.59 | 109 | 380 | 1.3465 | 64.1 | 0.052 | " |
| 31* | 0 | 184 | 2.64 | 111 | 400 | 1.3455 | 65.2 | 0.055 | |

*Note — Runs 29, 30 and 31 are controls

Table 4-B

| Run No. | Properties of textured yarns TC (%) | Dye Exhaustion (L value) | Dye Unevenness | Deformation (R value) | Remarks |
|---|---|---|---|---|---|
| 27 | 41.8 | 32.7 | no | 1.44 | |
| 28 | 42.2 | 32.5 | no | 1.42 | |
| 29* | 42.1 | 31.8 | found | 1.41 | |
| 30* | 34.3 | 28.6 | found | 1.36 | |
| 31* | 30.4 | 27.3 | found | 1.28 | numerous tight spots, great shrinkage during threading up operation |

*Note — Runs 29, 30 and 31 are controls

The physical properties of the feed yarns obtained in the several runs are shown in Table 4-A.

Next, the draw-texturing of the several feed yarns were carried out under identical conditions as in Run 6 of Example 1, the yarns being wound up at an overfeed of 4%. The properties of the so obtained textured yarns are shown in Table 4-B.

Runs 29, 30 and 31 demonstrate that a minimum heating zone length of 100cm is required to be within the scope of this invention. Even a length as close as 85cm (Run 29) is shown to produce non-uniform filaments that dye unevenly. Additionally, it should be noted that: Runs 30 and 31 each have Tenacities (Te) of less than 3 g/de; Runs 30 and 31 each have Break Elongations (El) of more than 80%;Runs 30 and 31 each have Initial Moduli (Mi) of less than 600 kg/mm²; Runs 29, 30 and 31 each have Boil-off Shrinkages (BOS) of much more than 8%; and Runs 30 and 31 each have Birefringences (Δn) of below 0.09. All of the above parameters are critical, and are given more fully earlier in the specification.

EXAMPLE 5

The feed yarn packages of Run 6 of Example 1 was mounted on a bobbin carriage and left to stand for a period of time in a chamber of 65% relative humidity at 40°C., following which the feed yarn was submitted to a draw-texturing under identical conditions as in Run 6 of Example 1.

The change in processability with the passage of time and the properties of the resulting textured yarn are shown in Table 5. It should be noted that there was very little difference in the measured values over a 90-day period, thus demonstrating the high stability of the yarns of this invention.

Table 5

| Run No. | Time Elapsed (days) | Processability: Pre-spindle Tension (g) | Post-spindle Tension (g) | Tension Ratio | Properties of Textured Yarns: Fluffs (per cheese) | Tight Spots (per 20m) | TC (%0) | Dye Exhaustion (L value) | Dye Unevenness |
|---|---|---|---|---|---|---|---|---|---|
| 32 | 0 | 27.4 | 50.0 | 1.8 | 0 | 0.2 | 40.1 | 32.2 | no |
| 33 | 10 | 28.0 | 53.5 | 1.9 | 0 | 0.3 | 41.2 | 33.1 | no |
| 34 | 20 | 27.0 | 52.5 | 1.9 | 0 | 0.2 | 40.9 | 32.7 | no |
| 35 | 30 | 27.5 | 52.5 | 1.9 | 0 | 0.3 | 40.7 | 32.4 | no |
| 36 | 60 | 29.2 | 51.0 | 1.9 | 0 | 0.2 | 40.5 | 33.5 | no |
| 37 | 90 | 28.8 | 51.4 | 1.8 | 0 | 0.4 | 40.9 | 33.3 | no |

Note: Tension Ratio = Post-spindle Tension/Pre-spindle Tension.

EXAMPLE 6

Run 6 of Example 1 was repeated, except that simultaneous draw-texturing of the feed yarn was carried out while varying the heat-setting temperature within the range of 170°–210°C. This was followed by heat treating the resulting yarn at 230°C. under relaxation of 16%, the yarn being wound up at an overfeed of 9% to prepare a "U-type" textured yarn.

The results obtained are shown in Table 6. All of these Runs are within the scope of the invention.

Table 6

| Run No. | Heat-setting Temp. (°C) | Properties of Textured Yarns: TC (%) | Torque (T/25cm) | Dye Exhaustion (L value) | Dye Unevenness | Deformation (R value) |
|---|---|---|---|---|---|---|
| 38 | 170 | 8.0 | 8 | 33.4 | No | 1.39 |
| 39 | 180 | 10.3 | 9 | 33.8 | No | 1.41 |
| 40 | 190 | 13.6 | 14 | 34.3 | No | 1.42 |
| 41 | 200 | 16.6 | 20 | 35.6 | No | 1.45 |
| 42 | 210 | 19.3 | 22 | 34.5 | No | 1.43 |

EXAMPLE 7

The feed yarn of Run 6 of Example 1 was drawn under the conditions of a hot pin temperature of 80°C., a draw ratio of 1.25 and a drawing speed of 350 meters per minute. Then, in a continuing process, it was false-twist-textured with an internally contacting frictional false-twisting tube having an inside diameter of 14 millimeters and rotating at 17,500 rpm. In carrying out this experiment, a heater 2 meters long was used, whose temperature was 230°C. The ratio of the surface speed of the frictional false twister to the yarn speed was held constant at 2.2, while the overfeed was varied. The properties of the resulting textured yarn are shown in Table 7. All of these Runs are within the scope of this invention.

Table 7

| Run No. | Overfeed (%) | Properties of Textured Yarns: TC (%) | Dye Exhaustion (L value) | Dye Unevenness | Deformation (R value) |
|---|---|---|---|---|---|
| 43 | −2 | 40.7 | 41.5 | No | 1.35 |
| 44 | −1 | 39.4 | 38.9 | No | 1.31 |
| 45 | 0 | 37.6 | 36.7 | No | 1.28 |
| 46 | 1 | 35.8 | 36.5 | No | 1.26 |

CONTROL

A feed yarn was made in a conventional manner as follows.

Chips of polyethylene terephthalate having a $[\eta]$ of 0.64 were melted and extruded at 288°C. from a spinneret having 30 holes of 0.35 mm in diameter. The freshly spun filaments were then cooled by blowing air at about 25°C. against the filaments at about right angles to the travel of the filaments, after which the filaments were coated with a finishing agent. The filaments were then taken up by a pair of godet rolls and wound up at a speed of 3,500 meters per minute. The so obtained spun yarn had the following properties.

| | | | |
|---|---|---|---|
| Titer | 241 de | DHS (at 180°C.) | 65.7% |
| Te | 2.56 g/de | DHS (at 200°C.) | 66.6% |
| El | 116% | DHS (at 220°C.) | 67.5% |
| Mi | 350 kg/mm² | Δn | 0.0453 |
| ρ | 1.3460 g/cm³ | L | Could not be measured. |
| BOS | 64% | Yp | 0.62 g/de |

This yarn, after its spinning, was left standing for one day in a chamber of 65% relative humidity at 25°C. Then the simultaneous draw-texturing was carried out using the same drawing and false-twisting machine as that used in Example 1 under the conditions of a spindle rotation speed of $26.1 \times 10^4$ rpm, a twist coefficient ($\alpha$) of 0.95, a heater length of 100 centimeters, a heat-setting temperature of 210°C. and a draw ratio of 1.5, the textured yarn being wound up at an overfeed of 4%. The processability and the properties of the resulting textured yarn are shown below.

| | | | |
|---|---|---|---|
| Pre-spindle tension | 23.6 g | TC | 42.3% |
| Post-spindle tension | 45.0 g | Dye exhaustion (L value) | 36.8 |
| Tension ratio | 1.9 | Dye unevenness | No |
| | | R value | 1.62 |
| | | Fluffs | No |

-continued

| | |
|---|---|
| Tight spots | No |

Immediately after completion of the foregoing texturing treatment, this yarn was placed in an atmosphere of 65% relative humidity at 40°C. and left standing there for 90 days. The yarn was then taken out and processed under identical conditions as those of the above-described draw-texturing treatment.

The processability and the properties of the resulting textured yarn are shown below.

| | | | |
|---|---|---|---|
| Pre-spindle tension | 35.5 g | TC | 41.8% |
| Post-spindle tension | 41.3 g | Dye exhaustion (L value) | 31.4 |
| Tension ratio | 1.16 | Dye unevenness | No |
| | | R value | 1.65 |
| | | Fluffs | 5 per cheese |
| | | Tight spots | 10 per 20 meters |

This data shows that a conventionally prepared yarn cannot be stored as long as the yarns of the subject invention, as disclosed in Table 5, Run No. 37, supra, without a marked deterioration in various critical properties.

We claim:

1. A process for producing a textured yarn from a feed yarn consisting essentially of a synthetic substantially linear ethylene terephthalate polyester multifilament containing at least 85 mol % of ethylene terephthalate units, which comprises drawing and false-twist texturing the feed yarn at a draw ratio of 1.05 – 1.30X using a heating zone having a heat-setting temperature of about 170° – 240°C, said feed yarn having (a) a break elongation of 40–80%, (b) a density of above 1.371 g/cm$^3$ and (c) a boil-off shrinkage of less than 8%.

2. A process according to claim 1 wherein the feed yarn has (a) a break elongation of 50–75%, (b) a density of 1.372 – 1.395 g/cm$^3$, (c) a boil-off shrinkage of 1–7%, (d) a birefringence of 0.09 14 0.14, (e) an initial modulus of 600–1100 kg/mm$^2$ and (f) a tenacity of 3 – 4 grams per denier.

3. A process according to claim 2 wherein the feed yarn has (a) a break elongation of 60 –70%, (b) a density of 1.373 – 1.394 g/cm$^3$, (c) a boil-off shrinkage of 2 – 6%, (d) a birefringence of 0.10 ° 0.13, and (e) an initial modulus of 700 – 900 kg/mm$^2$.

4. A process according to claim 1 wherein the feed yarn has a titer of 2 – 7 denier per filament.

5. A process according to claim 2 wherein the feed yarn has a strength at first yield point of 1.0 – 1.8 grams per denier and a crystal size of 30–45 angstroms.

6. A process according to claim 1 wherein the drawing and false-twist texturing are simultaneously conducted.

7. A process according to claim 1 wherein the yarn is draw-textured at a draw ratio of 1.10 – 1.25X.

8. A process according to claim 1 wherein the yarn is draw-textured at a heat-setting temperature of about 180° – 230°C.

9. A process according to claim 1 wherein the draw-textured yarn is subjected to a second heat-setting at a temperature of about 190° – 240°C and exceeding the temperature used in the initial heat setting by about 10°C, to produce an U-type low crimped textured yarn.

10. A process according to claim 9 wherein the second heat-setting temperature is about 200° – 240°C.

11. The process according to claim 9 wherein the initial heat-setting temperature is about 170° – 220°C.

12. The process according to claim 11 wherein the initial heat-setting temperature is about 180° – 210°C.

13. A process according to claim 1 wherein the heat-setting temperature is about 190° – 240°C to produce an O-type highly crimped textured yarn.

14. A process according to claim 13 wherein the heat-setting temperature is about 210° – 230°C, to produce an O-type highly crimped textured yarn.

15. A process according to claim 1 wherein the feed yarn is prepared by a modified melt-spinning process which comprises (i) extruding the synthetic linear ethylene terephthalate polyester having an intrinsic viscosity of 0.3 – 1.0 through a spinneret to form the filaments, (ii) cooling the filaments to a temperature of below (Tg + 40°C), wherein Tg means the second order transition temperature, (iii) passing the filaments through the heating zone having a length of about 100 – 200 cm heated at a temperature of about 140° – 210°C, and then (iv) winding up the obtained yarn at a speed of 2600 – 5500 meters per minute.

16. A process according to claim 15 wherein the filaments are cooled to a temperature of from (Tg – 20°C) to (Tg + 20°C) before passing through the heating zone.

17. A process according to claim 15, wherein the yarn is wound up at a speed of 3000 – 5000 meters per minute.

18. A process according to claim 15, wherein the heating zone is provided in a heating tube.

19. A process according to claim 15, wherein the heating zone is provided by a slit heater.

* * * * *

UNITED STATES PATENT AND TRADEMARK OFFICE

CERTIFICATE OF CORRECTION

PATENT NO. : 3,977,175

DATED : August 31, 1976

INVENTOR(S) : YOSHIKAWA, ET AL.

It is certified that error appears in the above-identified patent and that said Letters Patent are hereby corrected as shown below:

Claim 2, line 4, delete "0.09 14 0.14", insert -- 0.09 - 0.14 --

Claim 3, line 4, delete "0.10 ° 0.13", insert -- 0.10 - 0.13 --

Claim 9, line 5, delete "U-type", insert -- "U"-type --

Claim 13, line 3, delete "O-type", insert -- "O"-type --

Claim 14, line 3, delete "O-type", insert -- "O"-type --

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademark*